US005530461A

United States Patent [19]

Sakuma

[11] Patent Number: 5,530,461

[45] Date of Patent: Jun. 25, 1996

[54] INK EJECTING DEVICE

[75] Inventor: Mikio Sakuma, Ichinomiya, Japan

[73] Assignee: Brother Kogyo Kabushiki Kaisha, Nagoya, Japan

[21] Appl. No.: 213,733

[22] Filed: Mar. 16, 1994

[30] Foreign Application Priority Data

May 10, 1993 [JP] Japan ..... 5-108381

[51] Int. Cl.[6] ..... B41J 2/165

[52] U.S. Cl. ..... 347/23; 347/33; 347/45

[58] Field of Search ..... 347/45, 23, 33, 347/19, 14, 44

[56] References Cited

U.S. PATENT DOCUMENTS

| | | | |
|---|---|---|---|
| 5,202,702 | 4/1993 | Terasawa et al. . | |
| 5,398,054 | 3/1995 | Fukazawa et al. | 347/23 |

FOREIGN PATENT DOCUMENTS

| | | | |
|---|---|---|---|
| 0531535A1 | 3/1993 | European Pat. Off. . | |
| 3252748 | 10/1988 | Japan | 347/23 |
| 4025465 | 1/1992 | Japan | 347/19 |
| 4133743 | 5/1992 | Japan | 347/14 |

*Primary Examiner*—Benjamin R. Fuller
*Assistant Examiner*—Germaine Wilson
*Attorney, Agent, or Firm*—Oliff & Berridge

[57] ABSTRACT

A cleaning operation is directed by a CPU of an ink ejecting device every predetermined number of characters printed or when the power is turned on. The cleaning counter counts the number of cleaning times, the comparator compares a value in a table in ROM with the count value in the counter, and a message informing the user of the need for head replacement is displayed on the display of the operational panel when the numbers agree. Therefore, this ink ejecting device can inform the user of the appropriate time for head replacement.

22 Claims, 6 Drawing Sheets

INK EJECTING DEVICE

BACKGROUND OF THE INVENTION

1. Field of the Invention

The invention relates to an ink ejecting device having an ink ejecting head which is installed exchangeably therein.

2. Description of Related Art

In a conventional ink ejecting device, the ink ejecting head can be easily detached from the ink ejecting device and exchanged with a new one in consideration of the durability of the driving elements in the ink ejecting head. This type of ink ejecting device can be used much longer if the ink ejecting head is exchanged with a new one. Therefore, this type of device is very useful to users. There is a proposal that the head exchange time for such a device is determined for the user by counting the number of driving times of the driving element of the head and, at a predetermined count, replacing the ink ejecting head to prevent a decrease in the printing quality.

On the other hand, U.S. Pat. No. 5,202,702 discloses ink ejecting devices having a cleaning mechanism for cleaning the ink ejecting head. A wiper slides on a nozzle surface to clean dust or ink drip from the nozzle surface. Further, a water-repellent layer formed on the nozzle surface prevents unnecessary ink droplets from sticking to the nozzle surface. Due to the wiper and the water-repellent layer, ink droplets are ejected straight and exactly toward a printing medium. Recent ink ejecting devices have both the above-mentioned wiper and the water-repellent layer to achieve a higher-level printing quality. In these types of devices, the nozzle surface is cleaned by the wiper when the power is turned on or off, during printing operations, or after a predetermined number of characters or a predetermined number of pages have been printed.

However, since the driving elements of the ink ejecting devices have a longer durability, the exchange time is not determined until the driving elements are driven for quite a long time.

On the other hand, in the ink ejecting devices having both the wiper and the water-repellent layer, the water-repellent layer on the nozzle surface flakes off gradually whenever the cleaning operation is performed. Therefore, since it cannot be prevented that unnecessary ink droplets stick to the nozzle surface as the water-repellent layer is degraded, the printing quality is decreased. Especially if a pigment ink having good printing quality is used and the nozzle surface is cleaned sandwiching particles of the pigment ink between the water-repellent layer and the wiper, there is possibility that the water-repellent layer is easily flaked off. Moreover, since the cleaning operation is made whenever the power is turned on or off, the water-repellent layer flakes off more rapidly if the power is frequently turned on or off.

Since, in such ink ejecting devices, the cleaning operation occurs with the same timing as before the flaking-off of the water-repellent layer even after the water-repellent layer flakes off, unnecessary ink droplets stick to the nozzle surface for a long period of time and the printing quality is decreased during that period. It is possible that the user recognizes or the device has means to recognize the decrease in the printing quality for replacement of the ink ejecting head to thereby solve the above-mentioned problem. However, an ink ejecting head for use as a replacement is not always prepared for the user. In this case, the ink ejecting device cannot be used until the user obtains an ink ejecting head for replacement.

When the above-mentioned head exchange informing function is applied to the ink ejecting device having both the wiper and the water-repellent layer, the water-repellent layer flakes off before the driving elements wear out. Therefore, the printing quality decreases and the user normally does not notice the decrease in the printing quality, at least not until it has significantly decreased.

SUMMARY OF THE INVENTION

An object of the invention is to provide an ink ejecting device capable of informing a user of the appropriate head exchange time.

Another object of the invention is to provide an ink ejecting device capable of keeping a high printing quality for a long time by cleaning an ink ejecting head for an appropriate exchange timing.

To achieve the above objects, the ink ejecting device of the invention comprises an ink ejecting head installed detachably to the ink ejecting device, the ink ejecting head having a surface where nozzles are formed, the nozzles through which ink droplets are ejected, a water-repellent layer formed on the surface, a cleaning member for cleaning the surface, driving means for driving the cleaning member to slide relatively to the surface, control means for driving the driving means for a predetermined timing, first storing means for storing a first reference value obtained from a marginal number of cleaning times of the water-repellent layer, first counting means for counting a number of driving times of the control means, first comparing means for comparing the number counted by the first counting means and the first reference value stored in the first storing means and informing means for informing a user of a ink ejecting head replacement time based on an output from the first comparing means.

In the operation of the ink ejecting device as described above, the first storing means stores the first reference value obtained from the marginal number of cleaning times of the water-repellent layer and the first counting means counts the number of driving times of the control means. The first comparing means compares the first reference value and the number stored in the first counting means and the informing means informs the user of the ink ejecting head replacement time based on the output from the first comparing means.

As is clear from the above explanation, an ink ejecting device of the invention can inform the user of the appropriate head exchange time and prevent a decrease in printing quality. Moreover, because the head can always be cleaned at an appropriate timing in the ink ejecting device of the invention, the high printing quality can be maintained for a long time.

BRIEF DESCRIPTION OF THE DRAWINGS

A preferred embodiment of the invention will be described in detail with reference to the following figures, in which.

DETAILED DESCRIPTION OF THE PREFERRED EMBODIMENT

Figure 1:
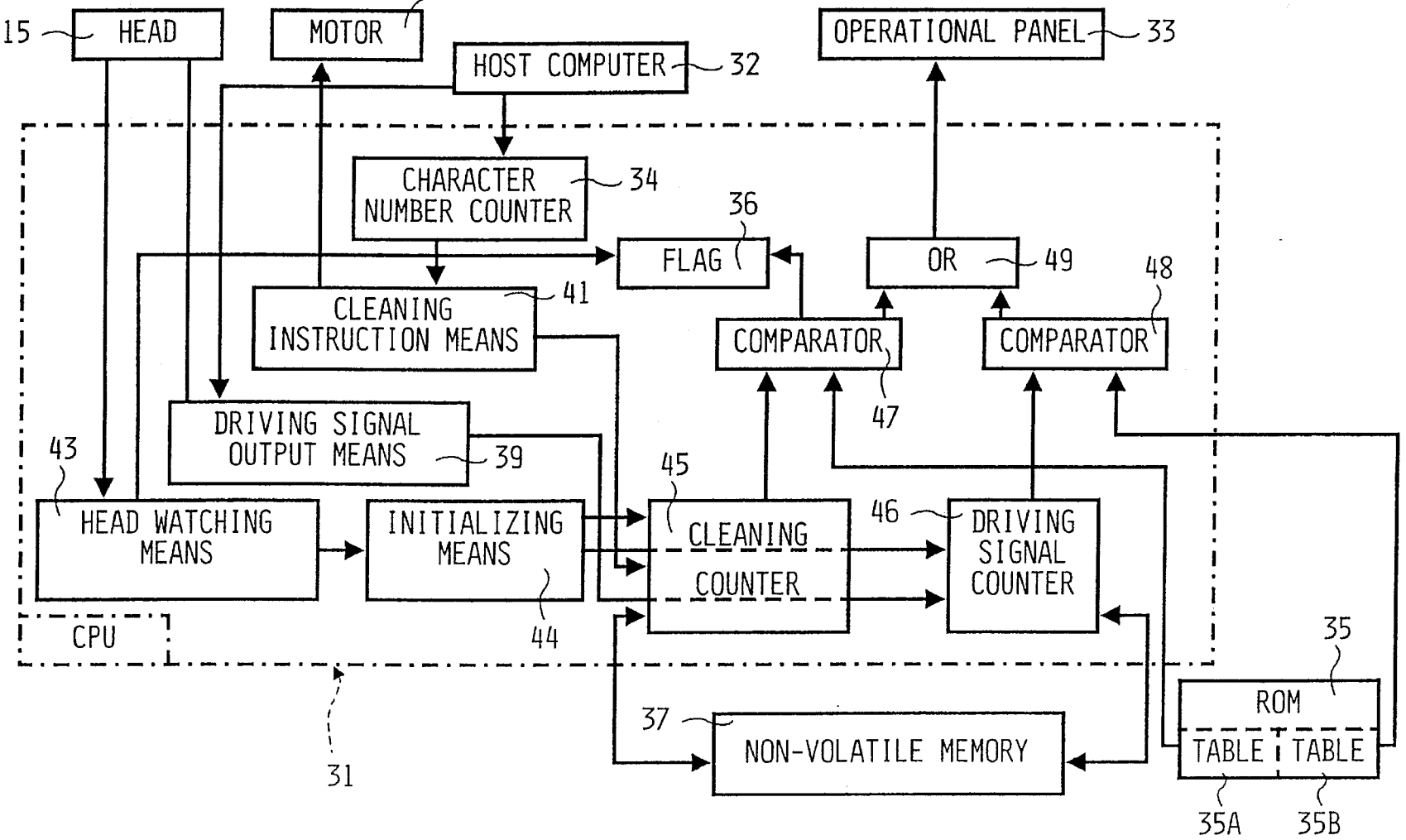
FIG. 1 is a block diagram showing the circuit structure of the ink ejecting device of the embodiment.

Hereafter, one embodiment of the invention is explained by referring to the drawings.

Figure 2:
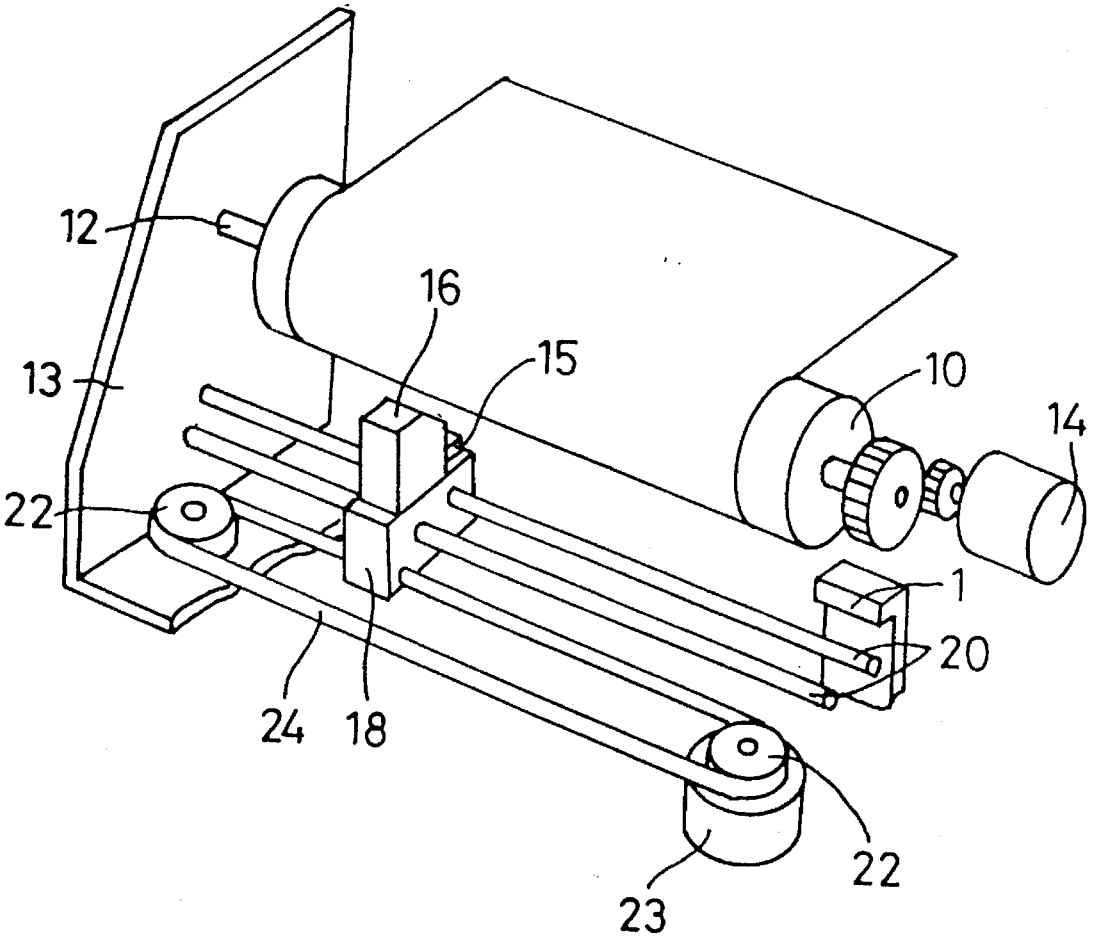
FIG. 2 is a perspective view showing the main part of the ink ejecting device of the embodiment.

The main part of the ink ejecting device of the embodiment is explained by referring to FIG. 2. A platen 10 is installed rotatably on a frame 13 by a shaft 12. The platen 10 is driven by a motor 14. An ink ejecting head 15 is installed on a carriage 18 with an ink cartridge 16 confronting the platen 10. The ink ejecting head 15 is detachable from the ink cartridge 16 and the carriage 18 by a detaching mechanism explained later. The carriage 18 is slidably supported by two guide rods 20 which are arranged parallel to the axis of the shaft 12 of the platen 10. Moreover, the carriage 18 is connected to a timing belt 24 which is wounded around a pair of pulleys 22. The carriage 18 moves along the platen 10 when one of the pulleys 22 is rotated by a motor 23 and the timing belt 24 is fed.

Moreover, a nozzle wiper 1 is installed in the ink ejecting device so that the ink ejecting head 15 faces the nozzle wiper 1 when the carriage 18 moves to a non-printing position which is aside from the platen 10.

The cleaning operation for the ink ejecting head 15 is as follows. When the cleaning instruction means sends a driving signal to the motor 23, the carriage 18 moves to the position of the nozzle wiper 1 and the nozzle surface of the ink ejecting head 15 slides on the nozzle wiper 1 to clean the nozzle surface.

Figure 3:
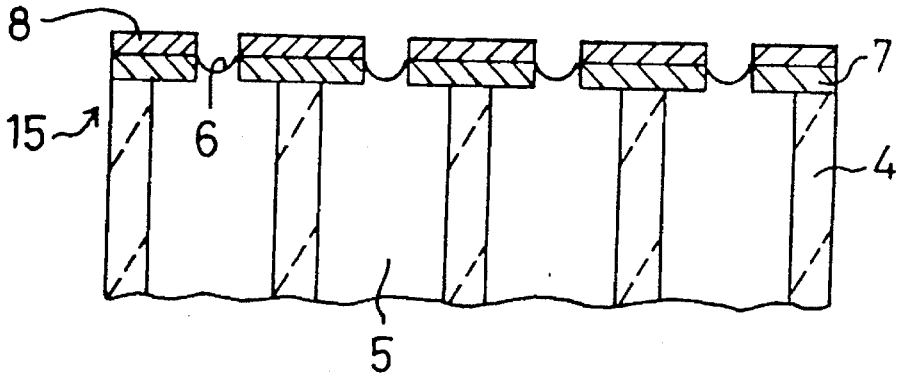
FIG. 3 is a cross-sectional view showing the nozzle part of the ink ejecting device of the embodiment.
Figure 4:
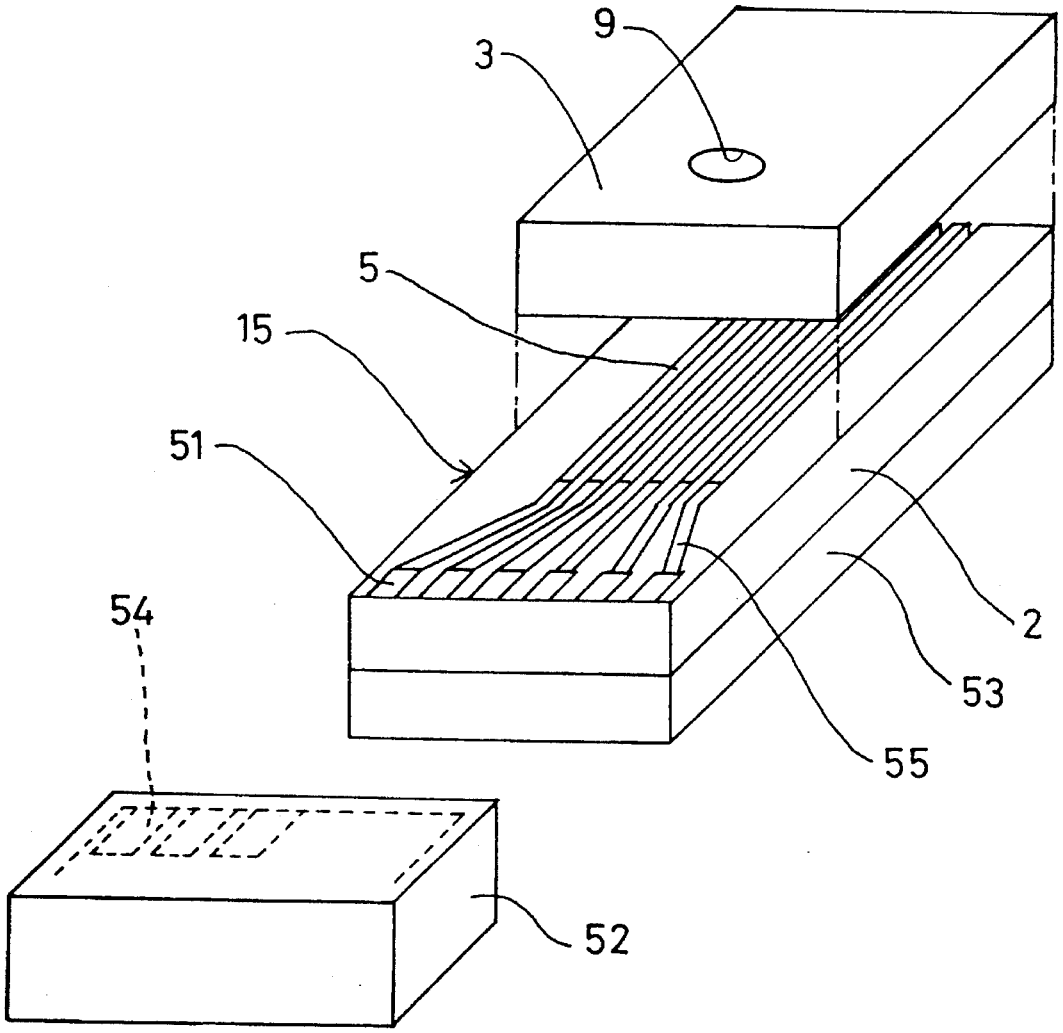
FIG. 4 is a perspective view showing the detachable head mechanism of the ink ejecting device of the embodiment.

The nozzle part is explained with reference to FIG. 3. The ink ejecting head 15 comprises side walls 4 which operate as driving elements, ink chambers 5 which are filled with ink, a nozzle plate 7 where nozzles 6 are arranged, and a cover plate 3 (FIG. 4). In this embodiment, the ink chambers 5 are filled with pigment ink containing carbon black.

A water-repellent layer 8 is formed on the surface of the nozzle plate 7. The water-repellent layer 8 is made from an uniform layer consisting of fluorine polymer. The water-repellent layer 8 is formed as follows: polymer solvent which is obtained by melting the fluorine polymer in a solvent is coated on the nozzle plate 7 by a dipping method. European Patent Publication No. 0 531 535 A1 discloses materials and a forming method for the water-repellent layer 8.

Due to the water-repellent layer 8 formed in the above-mentioned method, an ink meniscus can be formed at a predetermined position and thereby prevent unnecessary ink sticking on the surface of the nozzle plate 7. If unnecessary ink sticks onto the nozzle plate 7, especially around the nozzles 6, the ink droplets are not ejected straight toward a printing medium resulting in decreased printing quality. Further, the nozzles 6 can become clogged with the unnecessary ink which results in dot omission. However, these problems can be solved by forming the water-repellent layer 8.

However, the water-repellent layer 8 flakes off gradually whenever the above-mentioned cleaning operation is performed. A durability experiment for the ink ejecting device of this embodiment, using pigment ink, found that the water-repellent layer 8 does not flake off until approximately 10,000 cleaning operations. However, when over 10,000 cleaning operations occur, the layer 8 partially flakes off and a part of the surface of the nozzle plate 7 is exposed so that unnecessary ink sticks on the exposed surface of the nozzle plate 7.

Next, the detaching mechanism of the ink ejecting head 15 is explained by referring to FIG. 4. The ink ejecting head 15 comprises a piezoelectric ceramics plate 2 having the side walls 4 and the ink chambers 5 (see FIG. 3), the cover plate 3 having a manifold 9, the nozzle plate 7 (see FIG. 3) and a support plate 53. The piezoelectric ceramics plate 2 has driving electrodes (not shown) for transforming the side walls 4 into driving elements, conductive patterns 55 for energizing the driving electrodes and connecting electrodes 51 formed at the end of the conductive patterns 55. A connector 52 having connecting electrodes 54 is installed on the carriage 18 (FIG. 2). When the head 15 is detached or installed, the head 15 is pulled out from or inserted into the connector 52. Moreover, after the head 15 is connected with the connector 52, the ink cartridge 16 can be easily installed to the head 15 by connecting the ink cartridge 16 with the manifold 9 in a well-known method. Therefore, the user can easily replace the head 15 with a new one.

The durability experiment for the ink ejecting device of this embodiment verified that the marginal driving number of times of the driving elements is two billion and if the number of driving times is over two billion, the driving elements may be destroyed.

Next, the circuit structure of the ink ejecting device of the embodiment is explained by referring the block diagram of FIG. 1. The circuit structure having no direct relation to the embodiment is not explained.

CPU 31 controls the ink ejecting device of the embodiment and is connected with the motor 23 for driving the ink ejecting head 15 and carriage 18, an operational panel 33 having a display, ROM 35 for storing operational programs and a non-volatile memory 37 for storing changeable data. A table 35A in ROM 35 stores the value of 10,000 which is the marginal number of cleanings of the water-repellent layer 8 and a table 35B in ROM 35 stores the value of two billion which is the marginal number of driving times for the driving elements. Both of the values are stored in ROM 35 in advance.

CPU 31 operates as each of the following means in accordance with the operational programs. Driving signal output means 39 outputs driving signals to each driving element of the ink ejecting head 15 based on the printing data from a host computer 32. Whenever the power is turned on and after every one thousand characters are printed, the cleaning instruction means 41 outputs driving signals to the motor 23 and moves the carriage 18 to the nozzle wiper 1 to clean the head 15. Head watching means 43 always observes a conductive condition between the connecting electrodes 54 of the connector 52 and the connecting electrodes 51 on the head side and outputs signals to the initializing means 44 whenever the conductive condition becomes non-conductive. When the initializing means 44 receives the signal from the head watching means 43, the initializing means 44 outputs a reset signal to a cleaning counter 45 and a driving signal counter 46.

The cleaning counter 45 counts up a value one by one whenever the cleaning instruction means 41 outputs the driving signal to the motor 23 and then outputs the count value to a comparator 47. The driving signal counter 46 counts the number of the signals output from the driving signal output means 39 to a predetermined driving element and then outputs the count value to a comparator 48. The comparator 47 compares the value in the counter 45 with the value in the table 35A of ROM 35 and the comparator 48 compares the value in the counter 46 with the value in the table 35B of ROM 35. When a coincidence is obtained by either comparison, the appropriate comparator 47,48 outputs a signal to OR circuit 49. When the OR circuit 49 receives output from either one of the comparators 47,48, the OR circuit 49 sends a signal to the operational panel 33 to display a message informing the user to replace the head.

When a value coincidence is obtained by the comparator 47, that is when the number of cleaning times of the water-repellent layer 8 reaches the marginal value of 10,000, CPU 31 observes the signal from the head watching means 43 and changes the timing for cleaning the nozzle surface stored in the cleaning instruction means 41 from 1000 characters to 500 characters until the head is replaced. That is, the nozzle surface is initially cleaned by the nozzle wiper for every 1000 characters printed. However, after the number of cleaning times of the water-repellent layer 8 exceeds the marginal value of 10,000, the nozzle surface is cleaned after every 500 characters printed. Moreover, CPU 31 has a character number counter 34 for counting the number of printed characters and a flag 36 which is set to 1 after the number of cleaning times of the water-repellent layer 8 exceeds the marginal value until the head is replaced.

CPU 31 downloads the values stored in the cleaning counter 45 and the driving signal counter 46 into the non-volatile memory 37 whenever the printer power is turned off and uploads the values, stored in the non-volatile memory 37, into the cleaning counter 45 and the driving signal counter 46 whenever the printer power is turned on. Since a so-called software switch is used as a printer power in this embodiment, the CPU 31 can be operable while the printer power is off.

Figure 5:
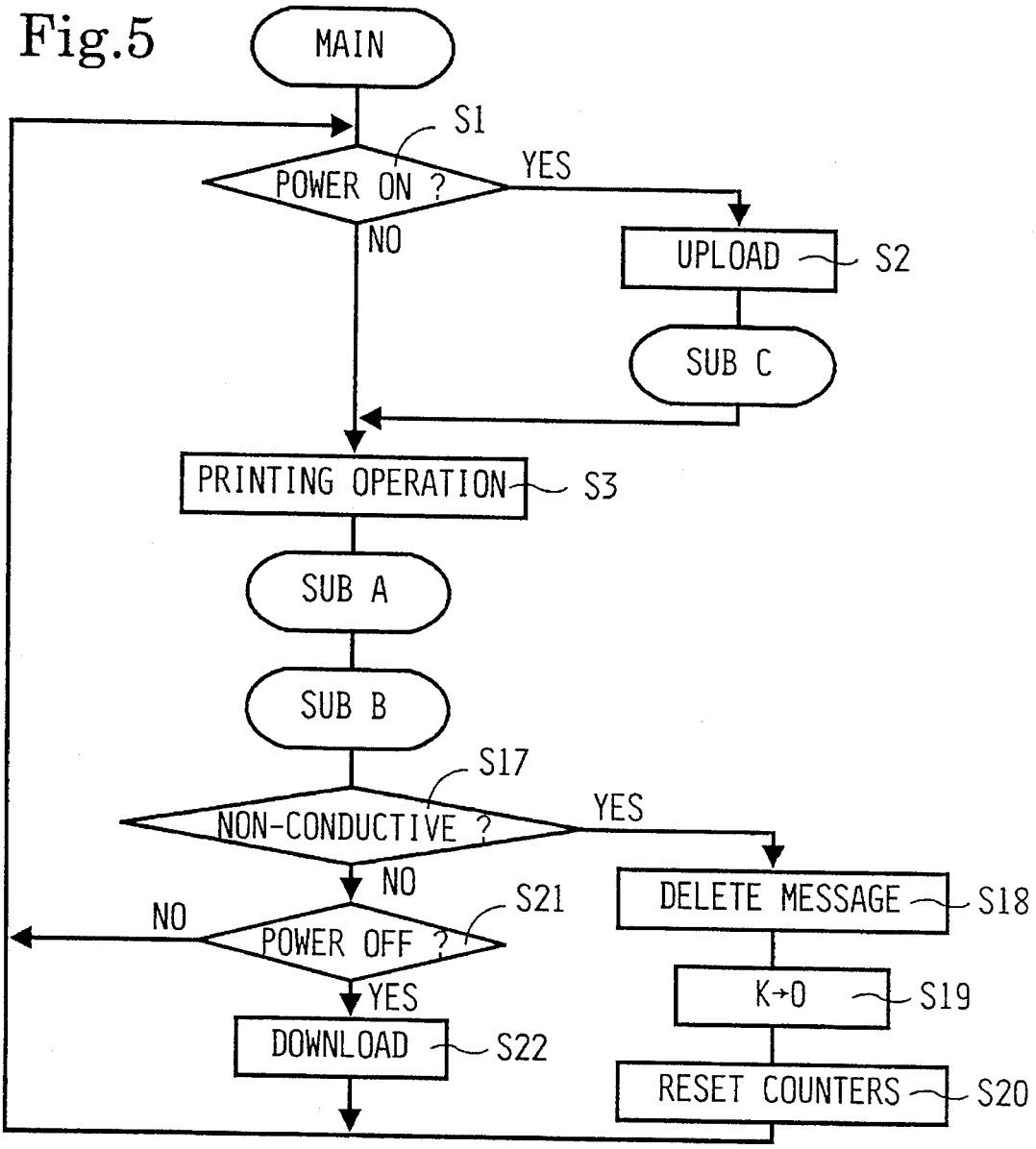
FIG. 5 is a flow chart of the operation of the ink ejecting device of the embodiment.

Operation of the embodiment will be explained by referring to the flowcharts of FIGS. 5 to 7. In step S1 it is determined whether the power is turned on. If the power is on (S1:YES), the number of cleaning times and the number of the driving signals stored in the non-volatile memory 37 are uploaded to the cleaning counter 45 and driving signal counter 46 respectively (S2). The processing then proceeds to sub C of FIG. 7. The process of sub C will be explained later.

Figure 6:
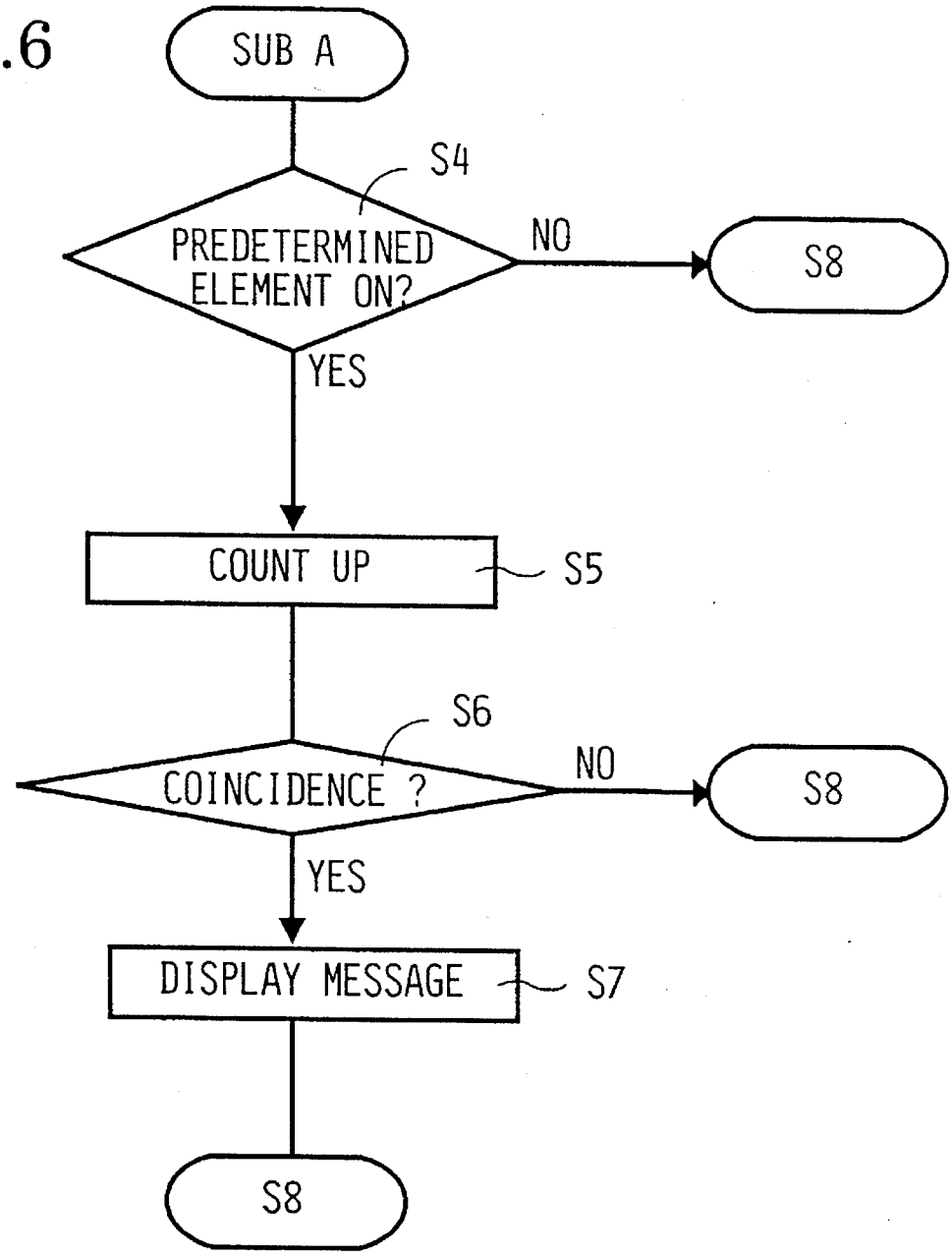
FIG. 6 is a flow chart of a sub-routine of FIG. 5.

If printing data is input through an interface (not shown) from the host computer 32, the driving signal output means 39 outputs the driving signal to each corresponding driving element (S3) and processing proceeds to sub A of FIG. 6. In step S4 it is determined whether the predetermined driving element is driven. If the predetermined driving element is driven (S4:YES), processing proceeds to step S5. If it is not driven (S4:NO), the process proceeds to step S8 of sub B (FIG. 7). In step S5, the value in the driving signal counter 46 is counted up, and, in step S6, the comparator 48 determines whether the counted value coincides with the value stored in the table 35B of ROM 35. If coincidence is obtained (S6:YES), that is the predetermined driving element has been driven for two billion times, the display of the operational panel 33 displays a message informing the user to replace the printhead in step S7. Step S7 is followed by step S8 of sub B (FIG. 7).

Figure 7:
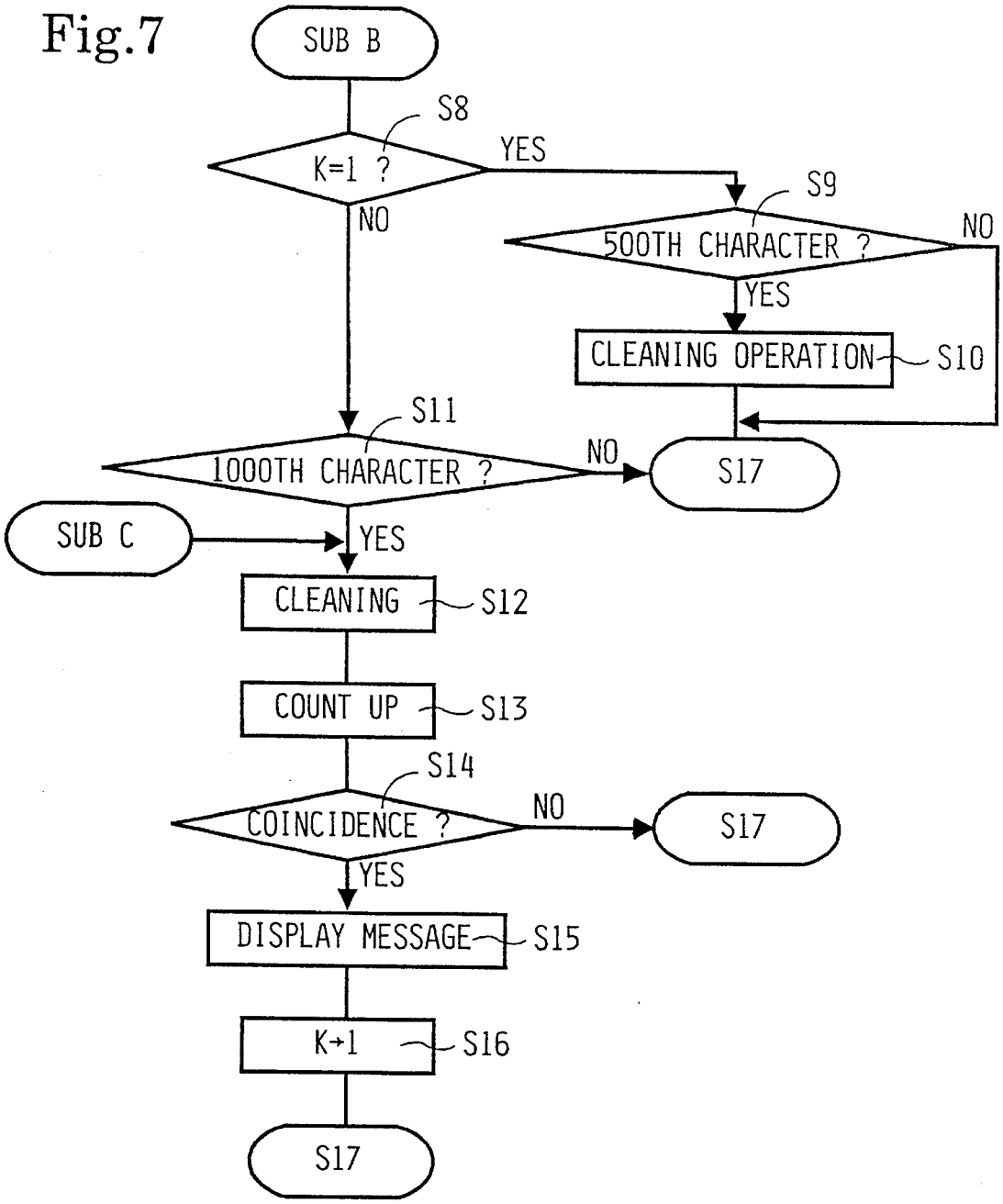
FIG. 7 is a flow chart of a sub-routine of FIG. 5.

The cleaning operation process of sub B is shown in FIG. 7. In step S8 it is determined whether the flag 36 is set to 1. The flag 36 is set to 1 after the number of cleaning times exceeds 10,000 until the head is replaced. When the flag 36 is set to 1 (S8:YES), the nozzle surface needs to be cleaned frequently because there is possibility that the water-repellent layer 8 is no longer effective. In step S9, it is determined whether the 500th character is to be printed as when k=1, that is, the flag 36 is 1, the cleaning timing is changed from every 1,000 characters, the initial value for cleaning, to every 500 characters. If the 500th character is to be printed (S9:YES) the value in the character counter 34 is reset after the cleaning operation in step S10 and processing proceeds to step S17 of FIG. 5. If the flag 36 is not set to 1 (k=0) (S8:NO), it is determined in step S11 whether the 1000th character is to be printed. If the 1000th character is to be printed (S11:YES), the value in the character counter 34 is reset after the cleaning operation in step S12. If the 1000th character is not to be printed (S11:NO), processing proceeds to step S17 of FIG. 5. Likewise, if the answer in step S9 is No, processing proceeds to step S17 of FIG. 5.

In step S13, the value in the cleaning counter 45 is counted up and in step S14 the comparator 47 determines whether the count value in the cleaning counter 45 coincides with the value in the table 35A of ROM 35. If the values coincide, that is 10,000 cleaning operations have occurred (S14:YES), the display on the operational panel 33 displays a message informing the user that replacement of the printhead is necessary in step S15. The flag 36 is set to 1 (k=1) in step S16 and processing proceeds to step S17 of FIG. 5.

In step S17, it is determined whether the printhead 15 is replaced by examining the conductive condition of the printhead 15 by using the head watching means 43. When the conductive condition of the printhead 15 becomes conductive after a non-conductive condition, it is determined that the printhead 15 has been replaced. If the printhead 15 is replaced with a new one (S17:YES), in step S18 the message informing the user to replace the printhead 15 is deleted from the display. In step S19, the flag 36 is reset to 0 (k=0) and in step S20 the values in the cleaning counter 45 and driving signal counter 46 are reset by the initializing means.

If the conductive condition is conductive (S17:NO), it is determined in step S21 whether the power is turned off. When the power is turned off (S21:YES), the number of cleaning times and the driving signals stored in the cleaning counter 45 and the driving signal counter 46 respectively are downloaded to the non-volatile memory 37 (S22).

The ink ejecting device of this embodiment having the above-described structure and operation monitors the durability of the driving elements based on the number of driving times of the driving elements. It also monitors the durability of the water-repellent layer 8 based on the number of times the water-repellent layer 8 is cleaned and informs the user of the appropriate printhead exchange time. Therefore, the ink ejecting device of this embodiment can solve the problem that the printing quality decreases due to the wear of the printhead although the user does not notice the decrease in the printing quality. Moreover, if the message informing the user of the necessity for printhead replacement is displayed on the display based upon the wear of the water-repellent layer 8, either the head is replaced with a new one when the message is observed or the cleaning operation occurs more frequently. In this latter case, the decrease in printing quality which would normally occur until the printhead is replaced is minimized.

It is to be understood that the invention is not restricted to the particular forms shown in the foregoing embodiment. Various modifications and alternations can be made thereto without departing from the scope of the invention encompassed by the appended claims.

For example, the head replacement can be determined by monitoring only the number of cleaning times, whereas the head replacement is determined when either one of the number of driving times of the driving elements or the number of cleaning times becomes a predetermined value in the above-embodiment. Especially if the printer power is frequently turned on or off, the number of cleaning times is increased greatly. Therefore, there is possibility that the water-repellent layer flakes off before the driving elements wear out. In this case, counting the number of driving times is meaningless.

Moreover, it is possible to determine whether the head replacement is necessary based upon the number of times the ink cartridge is replaced. Thus, a more adequate exchange time can be judged because the durability of the filter in the head and the degree of bubbles mixed in the ink can be taken into consideration. The number of cartridge replacing times can be counted by installing a switch for detecting the detaching and installing of the ink cartridge on the carriage.

In the above-embodiment, the CPU 31 monitors whether the power is turned off by using a softswitch to download the values in the cleaning counter 45 and the driving signal counter 46 to the non-volatile memory 37 while the power is off. However, a general power supply switch can be used if the values are stored in the non-volatile memory whenever the values in the counters 45 and 46 are changed.

While the number of driving times is counted for only a predetermined driving element in the above-embodiment, the replacement time can be determined more accurately if the number of driving times is counted for all driving elements and the message informing the user of the need for replacement is displayed when any one of the elements reaches a predetermined value. Moreover, the need for replacement of the printhead can be informed by using a warning sound. The replacement of the printhead can also be determined by use of a special switch or input from the operational panel by the user when the head is replaced.

The printhead replacement display occurs just before replacement of the printhead is necessary in the above-embodiment. However, the need for printhead replacement can be displayed earlier by setting the reference values of the number of driving times and cleaning times to a lower value. Additionally, the display can be made for informing the user how many printing medium can be printed until the head replacement if necessary in accordance with the number of printed printing medium and the number of driving times and cleaning times.

In the above-embodiment, when printhead replacement due to the water-repellent layer 8 is displayed, the device monitors whether the head is replaced and changes the cleaning timing from every 1000 characters to every 500 characters until the printhead is replaced. However, the cleaning timing can be changed step by step. For example, if the head is not replaced even after the cleaning operation for every 500 characters has been executed several times, the cleaning timing can be further reduced to every 300 characters. Thus, the decrease of printing quality can be minimized even more.

The predetermined values described in the above-embodiment, such as two billion as the number of driving times, 10,000 as the number of cleaning times, and the every 1000 or 500 characters of cleaning timing can be changed in accordance with the quality of the ink ejecting printhead. The cleaning timing can be changed by counting the number of printed pages instead of counting the number of printed characters. Further, a dye ink can be used instead of a pigment ink. In the above-embodiment, the ink ejecting head is replaced by a user. However, it is obvious that this invention can be applied to ink ejecting devices whose ink ejecting head is replaced by a service technician.

The above-embodiment explains one example which is applied to serial type ink ejecting devices using piezoelectric elements, however, this invention can be applied to other types of ink ejecting devices, such as bubble jet printers or line head printers.

What is claimed is:

1. An ink ejecting device, comprising:

an ink ejecting head detachably installed to the ink ejecting device, said ink ejecting head containing a plurality of ejection nozzles extending through a nozzle surface of said ink ejecting head, ink droplets being ejected through the ejecting nozzles;

a water-repellent layer formed on the nozzle surface;

a cleaning member for cleaning the nozzle surface;

driving means for driving the cleaning member to slide relative to the nozzle surface;

storing means for storing a reference value obtained from a predetermined number of cleaning times of the water-repellent layer;

counting means for counting a number of driving times of the driving means;

comparing means for comparing the number counted by the counting means and the reference value stored in the storing means to produce an output; and informing means for informing an operator of an ink ejecting head replacement time based on the output from the comparing means which indicates a degradation of the water-repellent layer.

2. The ink ejecting device as claimed in claim 1, further comprising non-volatile storing means for storing the number counted by the counting means.

3. The ink ejecting device as claimed in claim 1, further comprising detecting means for detecting a replacement of the ink ejecting head and initializing means for initializing the number stored in the counting means when the detecting means detects the replacement of the ink ejecting head.

4. The ink ejecting device as claimed in claim 1, further comprising:

an ink ejecting driving element;

additional storing means for storing an additional reference value obtained from a predetermined number of driving times of the driving element;

additional counting means for counting a number of driving times of the driving element; and additional comparing means for comparing the number in the additional counting means and the additional reference value stored in the additional storing means to produce an additional output, wherein the informing means informs the user of the ink ejecting head replacement time based on the output from the comparing means or the additional output from the additional comparing means.

5. The ink ejecting device as claimed in claim 1, further comprising:

control means for driving the driving means at a predetermined frequency; and changing means for changing the predetermined frequency for driving the driving means based on the number of driving times of the driving means counted by the counting means, wherein the predetermined frequency corresponds to a number of characters being printed.

6. An ink ejecting device, comprising:

an ink ejecting head detachably installed to the ink ejecting device, said ink ejecting head having a surface where nozzles are formed, ink droplets being ejected through the nozzles;

a water-repellent layer formed on the surface;

a cleaning member for cleaning the surface;

driving means for driving the cleaning member to slide relative to the surface;

control means for driving the driving means at a predetermined frequency;

counting means for counting a number of driving times of the driving means; and changing means for changing the predetermined frequency for driving the driving means based on the number of driving times of the driving means counted by the counting means which is based on a degradation of the water-repellent layer, wherein the predetermined frequency corresponds to a number of characters being printed.

7. The ink ejecting device as claimed in claim 6, further comprising non-volatile storing means for storing the number counted by the counting means.

8. The ink ejecting device as claimed in claim 6, further comprising:

storing means for storing a reference value obtained from a predetermined number of cleaning times of the water-repellent layer;

comprising means for comparing the number counted by the counting means and the reference value stored in the storing means;

an ink ejecting driving element;

additional storing means for storing an additional reference value obtained from a predetermined number of driving times of the driving element;

additional counting means for counting a number of driving times of the driving element;

additional comparing means for comparing the number in the additional counting means and the additional reference value stored in the additional storing means; and informing means for informing an ink ejecting head replacement time based on output from the comparing means or the additional comparing means.

9. The ink ejecting device as claimed in claim 6, further comprising:

additional driving means for causing ink droplets to be ejected from a nozzle, said control means driving said additional driving means;

additional counting means for counting a number of times said additional driving means is driven; and notification means for notifying an operator the ink ejecting head should be replaced.

10. The ink ejecting device as claimed in claim 9, further comprising an additional non-volative storing means for storing the number counted by the additional counting means.

11. The ink ejecting device as claimed in claim 6, further comprising:

a permanent memory storing a value that establishes a predetermined number of cleanings; and a comparator for comparing the value with the number counted by the counting means to change the predetermined frequency.

12. The ink ejecting device as claimed in claim 9, further comprising:

a permanent memory storing a value that establishes a desired number of cleanings and an additional value that establishes a desired number of ejections;

a comparator for comparing the value with the number counted by the counting means to change the predetermined frequency;

an additional comparator for comparing the additional value with the number counted by the additional counting means; and notification means for notifying an operator when a result of the comparator or the additional comparator indicates the number counted exceeds the respective value.

13. An ink ejecting device, comprising:

an ink ejecting head installed detachably to the ink ejecting device, said ink ejecting head having a surface where nozzles are formed, ink droplets being ejected through the nozzles;

a water-repellent layer formed on the surface;

a cleaning member for cleaning the surface;

driving means for driving the cleaning member to slide relative to the surface;

storing means for storing a reference value that establishes a predetermined number of cleanings of the water-repellent layer;

counting means for counting a number of driving times of the driving means; and informing means for informing an operator of an ink ejecting head replacement time based on the counting means which indicates degradation of the water-repellent layer.

14. The ink ejecting device as claimed in claim 13, wherein the reference value is obtained from a predetermined number of cleaning times.

15. The ink ejecting device as claimed in claim 13, further comprising comparing means for comparing the number counted by the counting means and the reference value stored in the storing means.

16. The ink ejecting device as claimed in claim 13, further comprising:

additional driving means for causing ink droplets to be ejected from a nozzle, said control means driving said additional driving means;

additional counting means for counting a number of times said additional driving means is driven; and notification means for notifying an operator the ink ejecting head should be replaced.

17. The ink ejecting device as claimed in claim 16, further comprising an additional non-volative storing means for storing the number counted by the additional counting means.

18. The ink ejecting device as claimed in claim 16, further comprising:

a permanent memory storing a value that establishes the predetermined number of cleanings and an additional value that establishes a predetermined number of ejections;

a comparator for comparing the value with the number counted by the counting means to change the predetermined timing;

an additional comparator for comparing the additional value with the number counted by the additional counting means; and notification means for notifying an operator when a result of the comparator or the additional comparator indicates the number counted exceeds the respective value.

19. The ink ejecting device as claimed in claim 13, further comprising non-volatile storing means for storing the number counted by the counting means.

20. The ink ejecting device as claimed in claim 13, further comprising detecting means for detecting a replacement of the ink ejecting head and initializing means for initializing the number stored in the counting means when the detecting means detects the replacement of the ink ejecting head.

21. The ink ejecting device as claimed in claim 13, further comprising:

an ink ejecting driving element;

additional storing means for storing an additional reference value obtained from a predetermined number of driving times of the driving element;

additional counting means for counting a number of driving times of the driving element; and additional comparing means for comparing the number in the additional counting means and the additional reference value stored in the additional storing means, wherein the informing means informs the user of the ink ejecting head replacement time based on an output from the comparing means or the additional comparing means.

22. The ink ejecting device as claimed in claim 13, further comprising:

control means for driving the driving means at a predetermined frequency; and changing means for changing the predetermined frequency for driving the driving means based on the number counted by the counting means.

* * * * *